US007025915B2

(12) United States Patent
Wang et al.

(10) Patent No.: US 7,025,915 B2
(45) Date of Patent: Apr. 11, 2006

(54) METHOD FOR PRODUCING ULTRAFINE FIBER AND ARTIFICIAL LEATHER

(75) Inventors: Ching-Tang Wang, Taipei (TW); Mong-Ching Lin, Kaohsiung (TW); Chung-Chin Feng, Kaohsiung (TW); Kuo-Kuang Cheng, Kaohsiung Hsien (TW); Chin-Yi Lin, Kaohsiung (TW)

(73) Assignee: San Fang Chemical Industry Co., Ltd., Renwu Shiang (TW)

( * ) Notice: Subject to any disclaimer, the term of this patent is extended or adjusted under 35 U.S.C. 154(b) by 277 days.

(21) Appl. No.: 10/393,777

(22) Filed: Mar. 21, 2003

(65) Prior Publication Data

US 2004/0045145 A1 Mar. 11, 2004

(30) Foreign Application Priority Data

Sep. 9, 2002 (TW) ..... 91120682 A

(51) Int. Cl.
*D01D 5/36* (2006.01)
*D04H 3/02* (2006.01)
*D04H 3/10* (2006.01)

(52) U.S. Cl. ..... 264/103; 28/104; 28/107; 264/172.13; 264/211.16

(58) Field of Classification Search ..... 264/103, 264/172.13, 211.16; 28/104, 107
See application file for complete search history.

(56) References Cited

U.S. PATENT DOCUMENTS 6,517,938 B1 * 2/2003 Andoh et al. ..... 428/395
6,528,139 B1 * 3/2003 Hoyt et al. ..... 428/97

* cited by examiner

*Primary Examiner*—Leo B. Tentoni
(74) *Attorney, Agent, or Firm*—Alan D. Kamrath; Nikolai & Mersereau, P.A.

(57) ABSTRACT

A method for producing an artificial leather includes mixed spinning an island polymer and a sea polymer having a different dissolving property from that of the island polymer at a predetermined temperature, producing a non-woven substrate from the fiber obtained, immersing the non-woven substrate into a polymer, dissolving and removing the sea polymer in the non-woven substrate to obtain an artificial leather as a semi-finished product, and polishing the surface of the artificial leather to obtain an artificial leather having excellent dyeability and advanced fluff-like property. The ratio of melt flow index of the sea polymer to relative viscosity of the island polymer is about 20 to about 55, in which the relative viscosity of the island polymer is about 2.7 to about 3.5 and the weight percentage of the sea polymer relative to the sum of the sea polymer and the island polymer is about 30% to about 70%.

25 Claims, 2 Drawing Sheets

METHOD FOR PRODUCING ULTRAFINE FIBER AND ARTIFICIAL LEATHER

BACKGROUND OF THE INVENTION

1. Field of the Invention

The present invention relates to a method for producing an artificial leather having excellent dyeability and advanced fluff-like property.

2. Description of the Related Art

Conventional methods for producing an artificial leather pertain to obtaining non-woven substrate from a fiber obtained by spinning polymeric material and obtaining the artificial leather by subjecting the non-woven substrate through a plurality of processing steps. It should be noted that to render the artificial leather being similar to genuine leather, the fiber for producing the non-woven substrate is preferably an ultrafine fiber.

Currently, there are two methods for producing the above-mentioned ultrafine fiber, one being a mixed spinning method and the other being a conjugate spinning method. Commonly speaking, the island in the fiber obtained by the mixed spinning method ranges from 0.01 to 0.0001 denier per filament, and it is impossible to obtain a fiber having more than 0.01 denier per filament. As the island has a low denier per filament, it is difficult to be dyed, which results in the difficulty for removing the sea between the islands. The islands in the fibers obtained in the conjugate spinning method range from 0.05 to 0.5 denier per filament, and it is impossible to obtain a fiber having less than 0.05 denier per filament. As the island has sufficiently high denier per filament, it is easy to be dyed. However, the high denier per filament brings the island to a surface with low gloss.

JP 63-243314 discloses a method for producing a fiber. The fiber is obtained by controlling the shear rate of polymers so that the island (referring to the big island) having larger cross-section in the fiber is homogeneously distributed in the central portions of the fiber and the island (referring to the small island) having smaller cross-section in the fiber is homogeneously distributed in the outer portions of the fiber. The fiber has high tenacity. However, due to the big island of the fiber thus obtained has lower than 0.02 denier per filament, it is not easy to dye the fiber. Furthermore, the high density of the small island brings difficulty for dissolving and removing the sea component of the fiber.

Taiwan Patent Application No. 78101985 discloses a method for producing an ultrafine fiber by conjugate spinning. The ultrafine fiber has an island having 0.3 to 0.05 denier per filament. Due to the limitation of diameter of the distribution plate of the spinneret, an island having consistent denier per filament is obtained. Hence, an artificial leather produced from the ultrafine fiber has poor feel and surface feather when compared to those of genuine leather.

Taiwan Patent Application No. 83109961 discloses a method for producing an ultrafine fiber by conjugate spinning, characterized by adding a polymer having different dissolving and removing property from that of the sea component into the sea component to form the island and dissolving and removing the sea component from the fiber thus obtained to produce a fiber having large island and small island simultaneously. However, the method pertains to a conjugate spinning process, which is tedious and complicated, and the fiber thus obtained has a small island having a size, which is too small to be easily dyed. Hence, the leather produced from the method still has surface not completely dyed.

Taiwan Patent Application No. 89121271 discloses a method for producing an ultrafine fiber by mixed spinning, in which the fiber has 0.0003 to 0.003 denier per filament. Due to the size of fiber island is small, it is difficult to dye the fibers and the fastness and leather tenacity is poor.

Accordingly, a mixed spinning process cannot produce an ultrafine fiber having about 0.01 to about 0.05 denier per filament and about 0.05 to about 0.5 denier per filament simultaneously.

Therefore, it is the purpose of the present invention to mitigate and/or obviate the drawbacks existing in the prior art in the manner set forth below.

SUMMARY OF THE INVENTION

Therefore, it is the purpose of the present invention to mitigate and/or obviate the drawbacks existing in the prior art in the manner set forth below.

Accordingly, it is an object of this invention to provide a method for producing an artificial leather, in which the fiber used in the method is produced by a mixed spinning process to result in the fiber having about 0.01 to 0.05 denier per filament and about 0.05 to 0.5 denier per filament, respectively, so as to render the artificial leather to be dyed easily, having a fastness of wet abrasion in dying of a grade above 3.5 and having excellent silk-like gloss.

The subject invention is directed to a method for producing an artificial leather, comprising the steps of mixed spinning an island polymer and a sea polymer having a different dissolving and removing property from that of the island polymer at a predetermined temperature (for instance from 150° C. to 285° C.) to produce a fiber preferably having a fineness of about 2 to about 10 denier per filament, producing a non-woven substrate from the fiber obtained by, for instances, knitting, needle punch or water-jet, immersing the non-woven substrate into a polymer, dissolving and removing the sea polymer in the non-woven substrate to obtain an artificial leather as a semi-finished product, and finally polishing the surface of the semi-finished artificial leather to obtain an artificial leather that is animal skin-like (for instance chamois leather) to the touch.

The subject invention is characterized by selecting a sea polymer and island polymer and controlling their mixing ratio according to specific parameters to obtain a fiber having islands with fineness ranging from about 0.01 to about 0.05 denier and ranging from about 0.05 to about 0.5 denier, respectively. After dissolving and removing the sea polymer, the artificial leather thus obtained has a fiber fineness ranging from about 0.01 to about 0.5 denier. More specifically, the above-mentioned specific parameters include (a) the ratio (D) of melt flow index (MI) of the sea component polymer to relative viscosity (RV) of the island component polymer ranges from about 20 to about 55, and (b) the relative viscosity (RV) of the island component polymer ranges from about 2.7 to about 3.5. Furthermore, an appropriate mixing ratio is that the weight of the sea component polymer relative to the sum of the sea component polymer and the island component polymer ranges from about 30% to about 70%.

The materials suitable for the island component polymer of the subject invention are polyamide polymer, which can be selected from nylon 6, nylon 66, nylon 11, nylon 12, nylon 610, 4,4'-diamino-dicyclohexylmethane 6 (PACM 6), polyamide elastomers, nylon 6/nylon 66 copolymer, nylon 6/nylon 11 copolymer or nylon 6/nylon 12 copolymer and the like.

The materials suitable for the sea component polymer of the subject invention can be selected from solvent-soluble polyolefin polymer (for example polystyrene and polyethylene), alkali-soluble polyester polymer containing sulfonic sodium and derivatives thereof (optionally with at least one component, for example para-terephthalic acid, aliphatic dicarboxylic acid, aromatic dicarboxylic acid, aliphatic diol, aromatic diol, carboxylic acid or derivatives thereof), and water-soluble polyvinyl alcohol or water-soluble polyester copolymer comprising isopropyl alcohol (IPA), terephthalic acid (TPA), acrylic acid (AA), sulfonic sodium salt (SIP), and polyethyleneglycol. Furthermore, additional lubricants (for example calcium stearate) can be incorporated into the island component polymer or sea component polymer to adjust the relative viscosity of the island component polymer or the melt flow index of the sea component polymer.

The subject invention, by simplified steps of a mixed spinning process, provides an ultrafine fiber having about 0.01 to 0.05 denier per filament and about 0.05 to 0.5 denier per filament, respectively. The fiber thus obtained can be used to produce an artificial leather by dissolving and removing the sea polymer in the fiber. The artificial leather can be dyed easily, has a fastness of wet abrasion in dying above 3.5 grade and having excellent silk-like gloss.

Furthermore, when producing non-woven fabric, a fabric having 10 g/m$^2$ to about 150 g/m$^2$ (for example fabric produced from nylon fiber, polyester fiber or polyolefin fiber) can be incorporated into the substrate. Alternatively, nylon staple fiber, polyester staple fiber or polyolefin staple fiber having a fiber fineness of about 1 to 6 denier can be directly incorporated into the substrate to reinforce the tenacity of leather.

Other objects, advantages, and novel features of the invention will become more apparent from the following detailed description when taken in conjunction with the accompanying drawings.

DETAILED DESCRIPTION OF THE PREFERRED EMBODIMENT

The subject invention provides a method for producing an artificial leather. In the method, an ultrafine fiber is produced by a mixed spinning process, and artificial leather is produced from the ultrafine fiber. The artificial leather thus produced has both ranges of fiber fineness, from about 0.01 to about 0.05 denier and from about 0.05 to about 0.5 denier to render the artificial leather to be easily dyed and having excellent silk-like gloss. The subject invention also pertains to selecting an appropriate sea polymer and island polymer and controlling their mixing ratio according to specific parameters to obtain fiber having islands with fineness ranging from about 0.01 to about 0.05 denier and ranging from about 0.05 to about 0.5 denier, respectively. After dissolving and removing the sea polymer, the artificial leather thus obtained has a fiber fineness ranging from about 0.01 to about 0.5 denier. The above-mentioned specific parameters include (a) the ratio (D) of melt flow index (MI) of the sea component polymer to relative viscosity (RV) of the island component polymer ranges from about 20 to about 55, and (b) the relative viscosity (RV) of the island component polymer ranges from about 2.7 to about 3.5. The melt flow index (MI) set forth in the subject invention is a polymer flow value determined under 230° C. by ASTM-D1238 test method. The relative viscosity (RV) is the viscosity of polymer dissolved in 96% sulfuric acid under 25° C.

Details of the ultrafine fiber and method for producing artificial leather are as follows.

Figure 1:
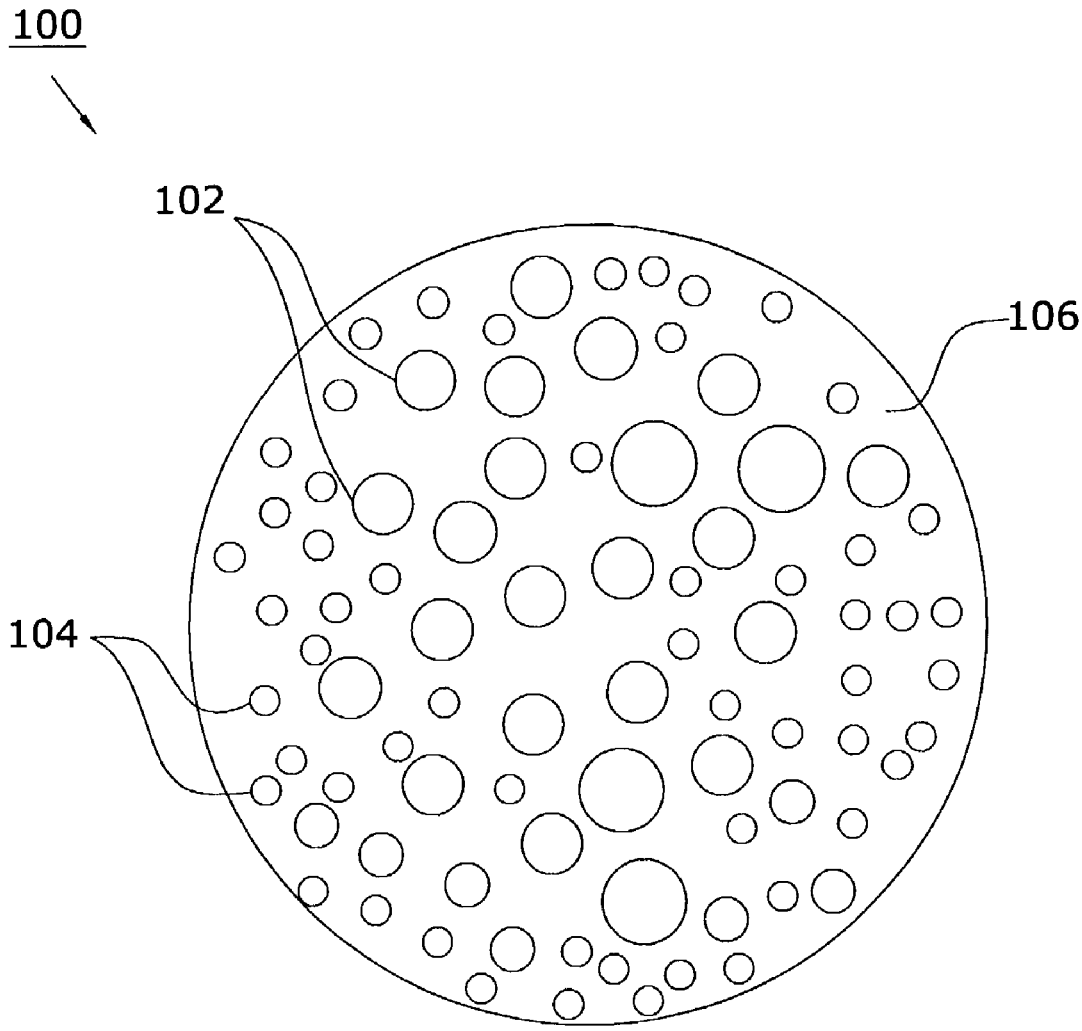
FIG. 1 is an embodiment of the subject invention showing a cross-sectional view of a fiber, which is produced by mixed spinning steps.

In the method for producing an artificial leather, the first step is to select a sea polymer and island polymer having different dissolving and removing properties on the basis of the above-mentioned parameters and to subject the polymers into a mixed spinning process under a predetermined temperature to produce an ultrafine fiber. More specifically, the sea polymer and island polymer, meeting the above ratio D and RV, respectively, are mixed in about 30:70 to about 70:30 weight percentage. In other words, the weight of the sea polymer relative to the sum of the sea polymer and the island polymer ranges from about 30% to about 70%. The mixture is melted in an extruder. The melt thus obtained preferably passes a tube provided with a static mixer and is extruded under about a spinning temperature of 150 to 285° C. through a spinneret. After being crimped, an undrawn yarn of fiber having about 4 to about 15 denier is obtained. Then, the drawn yarn is stretched about 2 to about 5 times. After being subjected to procedures such as corrugation and cutting, an ultrafine fiber having about 2 to about 10 denier is obtained. In the fiber, a fineness of island ranges from about 0.01 to about 0.05 denier and from about 0.05 to about 0.5 denier. The number of islands in the fiber is from 50 to about 300. FIG. 1 shows a cross-sectional view of a fiber 100 in an embodiment of the subject invention. In FIG. 1, the size of the islands having larger cross-section (referring to large islands 102) are controlled to be 0.05≦perimeter of island/perimeter of fiber≦0.15 and the size of the islands having smaller cross-section (referring to small islands 104) are controlled to be 0.01 perimeter of island/perimeter of fiber≦0.05. The islands 102 and islands 104 are surrounded by sea 106 formed from sea component polymer.

It should be noted that the relative viscosity (RV) of the island component polymer and the melt flow index (MI) of the sea component polymer can be adjusted by adding lubricants (for example calcium stearate). In addition, colorants (for example carbon black) can be added to the island component polymer to reinforce the blackness of fibers.

The materials suitable for the island component polymer of the subject invention are polyamide polymer, for example nylon 6, nylon 66, nylon 11, nylon 12, nylon 610, 4,4'-diamino-dicyclohexylmethane 6 (PACM 6), polyamide elastomers, nylon 6/nylon 66 copolymer, nylon 6/nylon 11 copolymer or nylon 6/nylon 12 copolymer and the like.

The materials suitable for the sea component polymer of the subject invention can be selected from the following three polymers. The first polymer is a solvent-soluble polyolefin polymer, for example polystyrene and polyethylene), The second polymer is an alkali-soluble polyester polymer containing sulfonic sodium and derivatives thereof (optionally with at least one component, for example para-terephthalic acid, aliphatic dicarboxylic acid, aromatic dicarboxylic acid, aliphatic diol, aromatic diol, carboxylic acid or derivatives thereof). The third polymer is a water-soluble polyvinyl alcohol or water-soluble polyester copolymer comprising isopropyl alcohol (IPA), terephthalic acid (TPA), acrylic acid (AA), sulfonic sodium salt (SIP), and polyethyleneglycol .

The fiber thus obtained is subjected to the steps of opening, carding, cross lapping, needle-punching and the like to produce a non-woven substrate. Then, the non-woven substrate is immersed into a polymer (for example solvent-soluble polyaminoester resin or water-soluble polyaminoester resin) and removing the sea component polymer in the non-woven substrate to obtain an artificial leather as a semi-finished product. Finally, the surface of the semi-finished product is polished and dyed, and an artificial leather that is animal skin-like (for instance chamois leather) to the touch is obtained.

According to the subject invention, by simplified steps, a fiber having fineness ranging from about 0.01 to about 0.05 denier and ranging from about 0.05 to about 0.5 denier can be obtained. Hence, the artificial leather can be easily dyed. According to AATCC-8 test standard, the artificial leather of the subject invention has a fastness of wet abrasion in dying of grade above 3.5 (the higher the grade, the better the fastness of wet abrasion in dying). In addition, according to the subject invention, fibers having different sizes are obtained, and the artificial leather based on the fibers have properties similar to those of genuine leather.

Furthermore, to overcome the poor strength problem of artificial leather having chamois-like properties, during the preparation procedures of producing non-woven fabric substrate, a fabric fiber having 10 g/m.sup.2 to about 150 g/m.sup.2 (for example nylon fiber, polyester fiber or polyolefin fiber) can combined with fiber to produce the non-woven fabric substrate. Alternatively, nylon staple fiber, polyester staple fiber or polyolefin staple fiber having a fiber fineness of about 1 to 6 denier can be directly incorporated into the substrate to reinforce the tenacity of leather.

The subject invention is illustrated in the following examples.

EXAMPLE 1

Nylon 6 having a RV of 3.0 is mixed with low density polyethylene having a MI of 60 in 50:50 weight ratio (a ratio (D) of 20, which meets the conditions in which $20 \leqq D \leqq 55$ and $2.7 \leqq RV \leqq 3.-5$). The mixture was melted in an extruder. Then, the melt was spun at 275° C., using a spinneret having a hole with a L/D ratio of 3. Under conditions that each hole has an output of 0.3 g/min and a rolling speed was 270 m/min, undrawn yarns were obtained, in which a single filament has a fineness of 10 denier, a tenacity of 1.5 g/den and an elongation of 300%.

Figure 2:
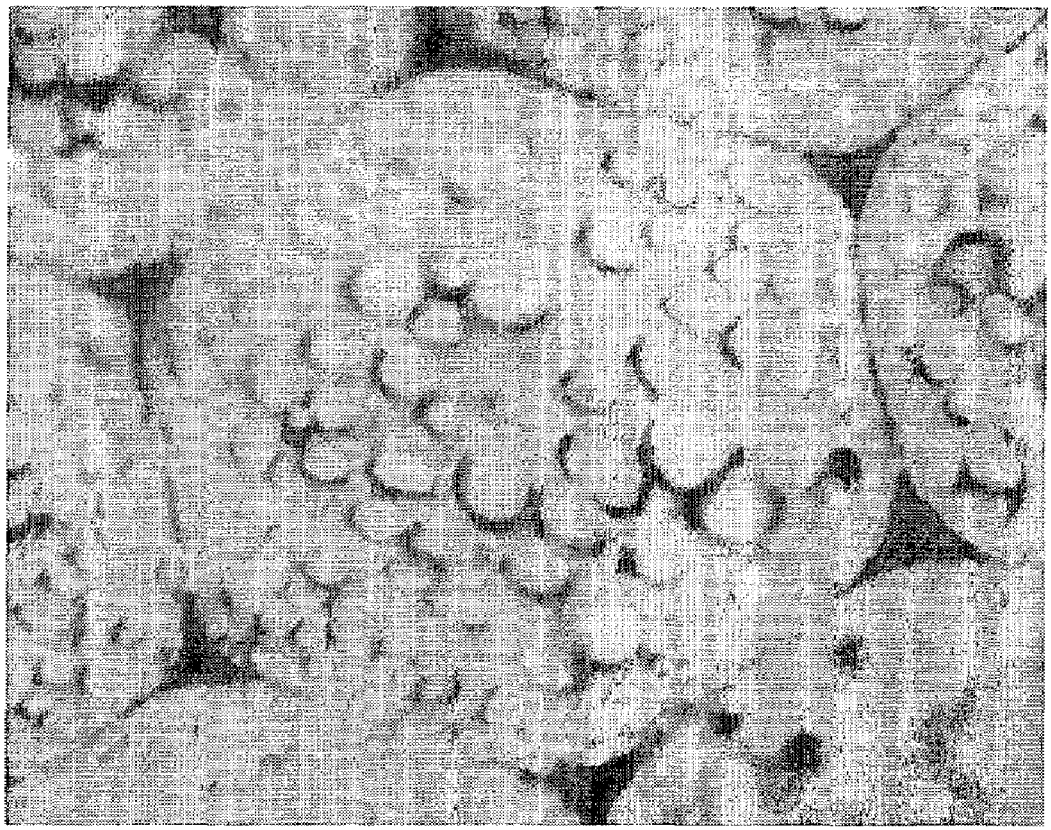
FIG. 2 is another embodiment of the subject invention showing a cross-sectional view of a fiber, which is produced by mixed spinning steps.

Undrawn yarns were stretched 2.5 times, and were crimped and cut to obtain staple fiber, in which a single filament has 4 denier of fineness, 3.0 g/den of strength and 50% of elongation. The photograph shown in FIG. 2 is a cross-section of fiber obtained by an optical microscope. There were about 220 islands in the fiber as shown in FIG. 2, in which 30 of them were big islands and 190 of them were small islands. In the big islands, the ratio of perimeter of island/perimeter of fiber was from 0.12 to 0.13 and its fineness was about 0.05 to 0.065 denier. In the small islands, the ratio of perimeter of island/perimeter of fiber was from 0.08 to 0.09 and its fineness was about 0.025 to 0.03 denier.

The ultrafine staple fiber was opened, carded, cross-lapped, and punched by needles to obtain a non-woven substrate having 450 g/m.sup.2. The substrate was immersed in a solvent-soluble polyurethane resin, and then solidified and was washed in water. Polyethylene was dissolved and removed by tetrachloroethylene. After being dried, a semi-finished artificial leather was obtained. An electron microscope was used to observe the conditions of the split fiber in leather cross-section. It was observed that the fibers were split into microfibers. Finally, the surface of leather was polished and was dyed by an acidic dye so as to obtain an artificial leather having a thickness of 1.0 mm, a fastness of wet abrasion in dying of a grade of 4 and having chamois-like property.

EXAMPLE 2

Nylon 6 having a RV of 2.7 is mixed with polyethylene terephthalate containing a sulfonic sodium salt having a MI of 70 in 50:50 weight ratio (the polyester having MI of 70 was formulated by blending polyethylene terephthalate containing sulfonic sodium salt of an intrinsic viscosity 0.63 with 10% calcium stearate powders). The ratio (D) is 25.9, which meets the conditions in which $20 \leqq D \leqq 55$ and $2.7 \leqq RV \leqq 3.5$). The mixture was melted in an extruder. Then, the melt was spun at 285° C., using a spinneret having a hole with a L/D ratio of 3. Under conditions that each hole has an output of 0.28 g/min and a rolling speed was 250 m/min, undrawn yams were obtained, in which a single filament has a fineness of 10 denier of a tenacity of 1.35 g/den and an elongation of 280%.

Undrawn yams were stretched 2.5 times, and were crimped and cut to obtain fiber, in which a single filament has a fineness of 4 denier, a tenacity of 2.5 g/den and an elongation of 30%. The cross-section of fiber was observed by an optical microscope. There were about 250 islands in the fiber, in which 70 of them were big islands and 180 of them were small islands. In the big islands, the ratio of perimeter of island/perimeter of fiber was from 0.1 to 0.12 and its fineness was about 0.04 to 0.05 denier. In the small islands, the ratio of perimeter of island/perimeter of fiber was from 0.06 to 0.07 and its fineness was about 0.015 to 0.02 denier.

The ultrafine staple fiber was opened, carded, cross-lapped, and punched by needles to obtain a nonwoven substrate having 500 g/m.sup.2. The substrate was immersed in a solvent-soluble polyurethane resin, and then solidified and washed in water. The sea component (polyethylene terephthalate containing sulfonic sodium) was removed by a sodium hydroxide solution. After being dried, a semi-finished artificial leather was obtained. An electron microscope was used to observe the conditions of the split fiber in the leather cross-section. It was observed that the fibers were split into microfibers. Finally, the surface of leather was polished and was dyed by acidic dye so as to obtain an artificial leather having a thickness of 1.2 mm, a fastness of wet abrasion in dying of a grade of 3.5 and having chamois-like property.

COMPARATIVE EXAMPLES

Nylon 6 having different RV and polyethylene having different MI are mixed in different weights to produce different fibers. Table 1 shows the comparisons of the fibers thus produced.

Item 1 pertains to a fiber obtained from mixing Nylon 6 having a RV of 2.4 and polyethylene having a MI of 50 in a 50:50 weight ratio. The RV of island component is below 2.7, which results in numerous islands (about 1000 islands). The fibers thus obtained have better tenacity but a poor fastness of wet abrasion in dying (grade 1).

Item 2 pertains to a fiber obtained from mixing Nylon 6 having a RV of 3.0 and polyethylene having a MI of 70 in a 25:75 weight ratio. As the weight ratio of sea and islands is beyond the controlled ranges, nylon 6 forms a sea component.

Item 3 pertains to a fiber obtained from mixing Nylon 6 having a RV of 2.7 and polyethylene having a MI of 60 in a 50:50 weight ratio. As the conditions in item 3 are within the scope of the present invention, the fiber thus obtained has appropriate numbers of islands, and excellent tenacity, spinning properties, and fastness of wet abrasion in dying.

TABLE 1

| Item | MI of sea component | RV of island component | D value | Weight ratio of MI/RV | number of islands | spinning properties | fastness of wet abrasion in dying (grade) | fiber tenacity |
|---|---|---|---|---|---|---|---|---|
| 1 | 50 | 2.4 | 20.8 | 50/50 | 1000 | Good | 1 | 3.5 |
| 2 | 70 | 3.0 | 23.3 | 25/75 | | Ordinary | — | — |
| 3 | 60 | 2.7 | 22.22 | 50/50 | 250 | Good | 4 | 3.0 |

While the present invention has been explained in relation to its preferred embodiments and illustrated with various drawings, it is to be understood that the embodiments shown in the drawings are merely exemplary and that various modifications of the invention will be apparent to those skilled in the art upon reading this specification. Therefore, it is to be understood that the invention disclosed herein is intended to cover all such modifications as shall fall within the scope of the appended claims.

What is claimed is:

1. A method for producing an artificial leather, comprising:

preparing an island polymer and a sea polymer having a different dissolving and removing property from that of said island polymer, wherein a ratio (D) of melt flow index (MI) of said sea polymer to relative viscosity (RV) of the island polymer ranges from about 20 to about 55, the relative viscosity (RV) of said island polymer ranges from about 2.7 to about 3.5, and the weight percentage of said sea polymer relative to the sum of said sea polymer and said island polymer ranges from about 30% to about 70%;

mixed spinning the island polymer and the sea polymer at a predetermined temperature to produce a fiber having a fineness of about 2 to about 10 denier per filament, wherein said islands in said fiber has a fineness ranging from about 0.01 to about 0.05 denier per filament and from about 0.05 to about 0.5 denier per filament, said islands having a fineness ranging from about 0.01 to about 0.05 denier per filament has a ratio of perimeter of island/perimeter of fiber ranging from 0.01 to 0.05. and said islands having a fineness ranging from about 0.05 to about 0.5 denier per filament has a ratio of perimeter of island/perimeter of fiber ranging from 0.05 to 0.15;

producing a non-woven fabric substrate from said fiber;

forming an artificial semi-finished leather by immersing said non-woven fabric substrate into a polymer; and dissolving and removing said sea polymer in said artificial semi-finished leather; and polishing a surface of said artificial semi-finished leather.

2. A method according to claim 1, wherein during said mixed spinning step, said fiber has about 50 to about 300 islands therein.

3. A method according to claim 1, wherein said island polymer is polyamide polymer.

4. A method according to claim 3, wherein said polyamide polymer is selected from the group consisting of nylon 6, nylon 66, nylon 11, nylon 12, nylon 610, 4,4'-diaminodicyclohexylmethane 6 (PACM 6), polyamide elastomers, nylon 6/nylon 66 copolymer, nylon 6/nylon 11 copolymer or nylon 6/nylon 12 copolymer.

5. A method according to claim 1, wherein said sea polymer is selected from the group consisting of polyolefin polymer, polyester polymer containing sulfonic sodium salt, polyvinyl alcohol and water-soluble polyester copolymer comprising isopropyl alcohol (IPA), terephthalic acid (TPA), acrylic acid (AA), sulfonic sodium salt (SIP), and polyethyleneglycol.

6. A method according to claim 5, wherein said polyolefin polymer is selected from the group consisting of polystyrene and polyethylene.

7. A method according to claim 5, wherein said polytester polymer containing sulfonic sodium salt further comprises a component selected from the group consisting of paraterephthalic acid, aliphatic dicarboxylic acid, aromatic dicarboxylic acid, aliphatic diol, aromatic diol, carboxylic acid and derivatives thereof.

8. A method for producing an artificial leather, comprising:

preparing an island polymer and a sea polymer having a different dissolving and removing property from that of said island polymer, wherein a ratio (D) of melt flow index (MD of said sea polymer to relative viscosity (RV) of the island polymer ranges from about 20 to about 55, the relative viscosity (RV) of said island polymer ranges from about 2.7 to about 3.5, and the weight percentage of said sea polymer relative to the sum of said sea polymer and said island polymer ranges from about 30% to about 70%;

mixed spinning the island polymer and the sea polymer at a predetermined temperature to produce a fiber;

adding a fabric having about 10g/m$^2$ to about 150 g/m$^2$ into said fiber to form a non-woven fabric substrate;

forming an artificial semi-finished leather by immersing said non-woven fabric substrate into a polymer; and dissolving and removing said sea polymer in said artificial semi-finished leather; and polishing a surface of said artificial semi-finished leather.

9. A method according to claim 8, wherein said fabric is formed from nylon fiber.

10. A method according to claim 8, wherein said fabric is formed from polyester fiber.

11. A method according to claim 8, wherein said fabric is formed from polyolefin fiber.

12. A method according to claim 1, further comprising a step of adding nylon staple fiber having a fineness of about 1 denier per filament to about 6 denier per filament into said non-woven fabric substrate.

13. A method according to claim 1, further comprising a step of adding polyester staple fiber having a fineness of about 1 denier per filament to about 6 denier per filament into said non-woven fabric substrate.

14. A method according to claim 1, further comprising a step of adding polyolefin staple fiber having a fineness of about 1 denier per filament to about 6 denier per filament into said non-woven fabric substrate.

15. A method according to claim 1, wherein said predetermined temperature ranges from about 150° C. to about 285° C.

16. A method according to claim 1, wherein said step for producing non-woven substrate comprising a step of using needlepunch.

17. A method according to claim 1, wherein said step for producing non-woven substrate comprising a step of using water-jet.

18. A method for producing an ultrafine fiber, comprising:

preparing an island polymer and a sea polymer having a different dissolving property from that of said island polymer, wherein a ratio (D) of melt flow index (MI) of said sea polymer to relative viscosity (RV) of the island polymer ranges from about 20 to about 55, the relative viscosity (RV) of said island polymer ranges from about 2.7 to about 3.5, and the weight percentage of said sea polymer relative to the sum of said sea polymer and said island polymer ranges from about 30% to about 70%; and mixed spinning the island polymer and the sea polymer at a predetermined temperature to produce a fiber having a fineness of about 2 to about 10 denier per filament, wherein said islands in said fiber has a fineness ranging from about 0.01 to about 0.05 denier per filament and from about 0.05 to about 0.5 denier per filament, said islands having a fineness ranging from about 0.01 to about 0.05 denier per filament has a ratio of perimeter of island/perimeter of fiber ranging from 0.01 to 0.05. and said islands having a fineness ranging from about 0.05 to about 0.5 denier per filament has a ratio of perimeter of island/perimeter of fiber ranging from 0.05 to 0.15.

19. A method according to claim 18, wherein during said mixed spinning step, said fiber has about 50 to about 300 islands therein.

20. A method according to claim 18, wherein said island polymer is polyamide polymer.

21. A method according to claim 20, wherein said polyamide polymer is selected from the group consisting of nylon 6, nylon 66, nylon 11, nylon 12, nylon 610, 4,4'-diaminodicyclohexylmethane 6 (PACM 6), polyamide elastomers, nylon 6/nylon 66 copolymer, nylon 6/nylon 11 copolymer or nylon 6/nylon 12 copolymer.

22. A method according to claim 18, wherein said sea polymer is selected from the group consisting of polyolefin polymer, polyester polymer containing sulfonic sodium salt, polyvinyl alcohol and water-soluble polyester copolymer comprising isopropyl alcohol (IPA), terephthalic acid (TPA), acrylic acid (AA), sulfonic sodium salt (SIP), and polyethyleneglycol.

23. A method according to claim 22, wherein said polyolefin polymer is selected from the group consisting of polystyrene and polyethylene.

24. A method according to claim 22, wherein said polytester polymer containing sulfonic sodium salt further comprises a component selected from the group consisting of para-terephthalic acid, aliphatic dicarboxylic acid, aromatic dicarboxylic acid, aliphatic diol, aromatic diol, carboxylic acid and derivatives thereof.

25. A method according to claim 18, wherein said predetermined temperature ranges from about 150° C. to about 285° C.

* * * * *